US008452071B2

(12) United States Patent
Shih et al.

(10) Patent No.: US 8,452,071 B2
(45) Date of Patent: May 28, 2013

(54) SELF-SERVICE TERMINAL AND METHOD FOR STORING CURRENCY IN SELF-SERVICE TERMINAL

(75) Inventors: Chih-Kun Shih, Santa Clara, CA (US); Wan-Cheng Luo, Shenzhen (CN); Xiao-Mao Xie, Shenzhen (CN); Wei Xu, Shenzhen (CN); Xiang-Xiong Xiao, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 159 days.

(21) Appl. No.: 12/969,184

(22) Filed: Dec. 15, 2010

(65) Prior Publication Data

US 2012/0020543 A1 Jan. 26, 2012

(30) Foreign Application Priority Data

Jul. 23, 2010 (CN) ..... 2010 1 0235442

(51) Int. Cl.
*G07D 7/20* (2006.01)
*G07D 11/00* (2006.01)

(52) U.S. Cl.
CPC ..... *G07D 11/0021* (2013.01); *Y10S 902/07* (2013.01)
USPC ..... 382/135; 382/137; 235/379; 356/71; 902/7

(58) Field of Classification Search
USPC ..... 382/135, 137, 138, 139, 140; 194/206, 194/217; 235/375, 379
See application file for complete search history.

(56) References Cited

U.S. PATENT DOCUMENTS

| | | | | |
|---|---|---|---|---|
| 6,547,132 | B1 * | 4/2003 | Templeton et al. | 235/380 |
| 7,028,886 | B1 * | 4/2006 | Maloney | 235/375 |
| 7,454,049 | B2 * | 11/2008 | Paraskevakos | 382/135 |
| 8,162,125 | B1 * | 4/2012 | Csulits et al. | 194/206 |
| 2003/0132281 | A1 * | 7/2003 | Jones et al. | 235/379 |
| 2004/0028266 | A1 * | 2/2004 | Jones et al. | 382/135 |
| 2004/0238619 | A1 * | 12/2004 | Nagasaka et al. | 235/379 |
| 2009/0229947 | A1 * | 9/2009 | Takai et al. | 194/206 |
| 2010/0063916 | A1 * | 3/2010 | Jones et al. | 705/35 |
| 2010/0289627 | A1 * | 11/2010 | McAllister et al. | 340/10.42 |
| 2011/0111866 | A1 * | 5/2011 | Anthony et al. | 463/46 |

* cited by examiner

*Primary Examiner* — Stephen R Koziol
*Assistant Examiner* — Shaghayegh Azima
(74) *Attorney, Agent, or Firm* — Altis Law Group, Inc.

(57) ABSTRACT

A self-service terminal for storing currency, includes a detection unit, an image capturing unit, a database, and a serial number reading unit. The detection unit detects the currency. The image capturing unit is connected to the detection unit, and captures an image of a side of the currency on which a string of serial numbers are printed. The database is connected to the image capturing unit. The database includes depositor's information stored therein. The database saves the image therein. The serial number reading unit is connected to the database. The serial number reading unit captures the string of serial numbers from image. The database saves the string of serial numbers therein, and associates the string of serial numbers with the information of the depositor.

4 Claims, 2 Drawing Sheets

SELF-SERVICE TERMINAL AND METHOD FOR STORING CURRENCY IN SELF-SERVICE TERMINAL

BACKGROUND

1. Technical Field

The present disclosure relates to a self-service terminal and a method for storing currency in the self-service terminal having a function of tracing the source of counterfeit currency.

2. Description of Related Art

Self-service terminals are developed to process many daily financial transactions, such as saving currency, withdrawing currency, and inquiring account information. Therefore, the self-service terminal must have a function of preventing fraud, such as detecting counterfeit currency when the saving transaction is done. However, because there are so many new counterfeit technologies, it is hard to keep up to date with all of them. In some cases, the counterfeit currency can be wrongly detected as not counterfeit currency and can be stored in the self-service terminal, which causes losses to the bank, that possesses the self-service terminal.

Therefore, there is room for improvement within the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
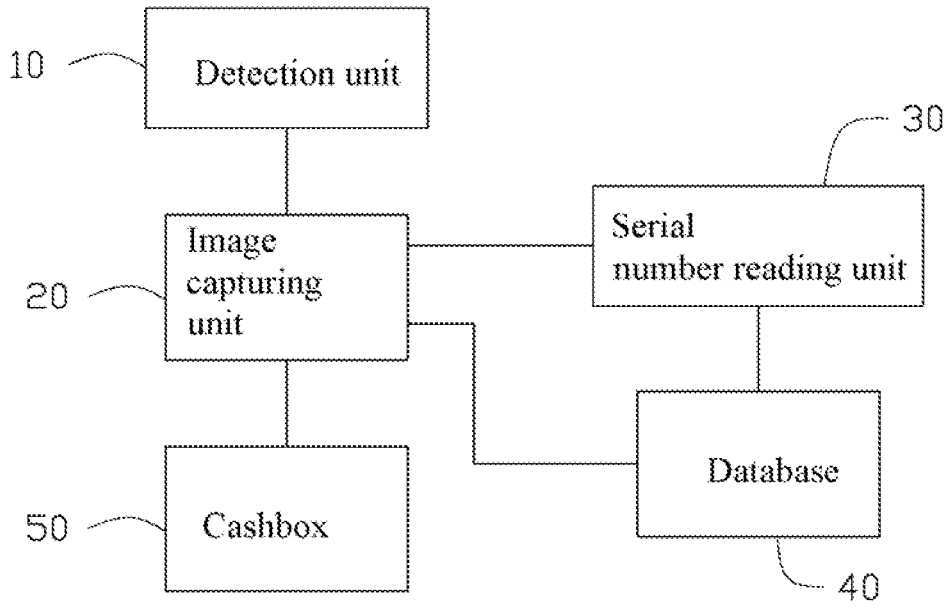
FIG. 1 is a block view of a self-service terminal in accordance with an embodiment.

Referring to FIG. 1, a self-service terminal in accordance with an embodiment includes a detection unit 10, an image capturing unit 20, a serial number reading unit 30, a database 40, and a cashbox 50.

The detection unit 10 detects whether a currency received by the self-service terminal is counterfeit. If the detection unit 10 detects the currency is counterfeit, the self-service terminal rejects the storage of the currency. If the detection unit 10 detects the currency is not counterfeit, the currency is sent to the image capturing unit 20.

The image capturing unit 20 is used to capture an image of the currency that is sent from the detection unit 10. The side of the currency, on which, a string of serial numbers are printed, is directed towards the capturing unit 20. The image capturing unit 20 captures an image of the side of the currency to get a corresponding image file.

The database 40 is connected to the image capturing unit 20. In one embodiment, the database 40 pre-stores all of the depositors' information of a bank which possesses the self-service terminal. In another embodiment, the database 40 connects to a central database that stores all of the depositors' information of the bank. In the database 40 or the central database, the information of each depositor is stored as a tag file. The tag files stores corresponding depositor's name, account, and identification information. When the currency is sent to the image capturing unit 20, the image capturing unit 20 captures an image of the currency to generate a corresponding image file. Then, the image file, time, and place of this transaction are combined into a tag file of the depositor who saves the currency.

The serial number reading unit 30 is connected to the database 40. The serial number reading unit 30 processes the image file stored in the database 40 to capture the serial numbers. If the serial numbers are clear, the serial number reading unit 30 can successfully capture the serial numbers. However, if the serial numbers are not clear, the serial number reading unit 30 cannot successfully capture the serial numbers. When the serial numbers can successfully captured, the serial number reading unit 30 notifies the database 40 to delete the corresponding image file and sends the captured serial numbers to the database 40. The database 40 combines the serial numbers in the corresponding tag file. When the serial number reading unit 30 cannot successfully capture the serial numbers, the serial number reading unit 30 notifies the database 40 to retain the corresponding image file.

The cashbox 50 is connected to the image capturing unit 20. The cashbox 50 stores the currency after the image capturing unit 20 captures the image of the currency.

Figure 2:
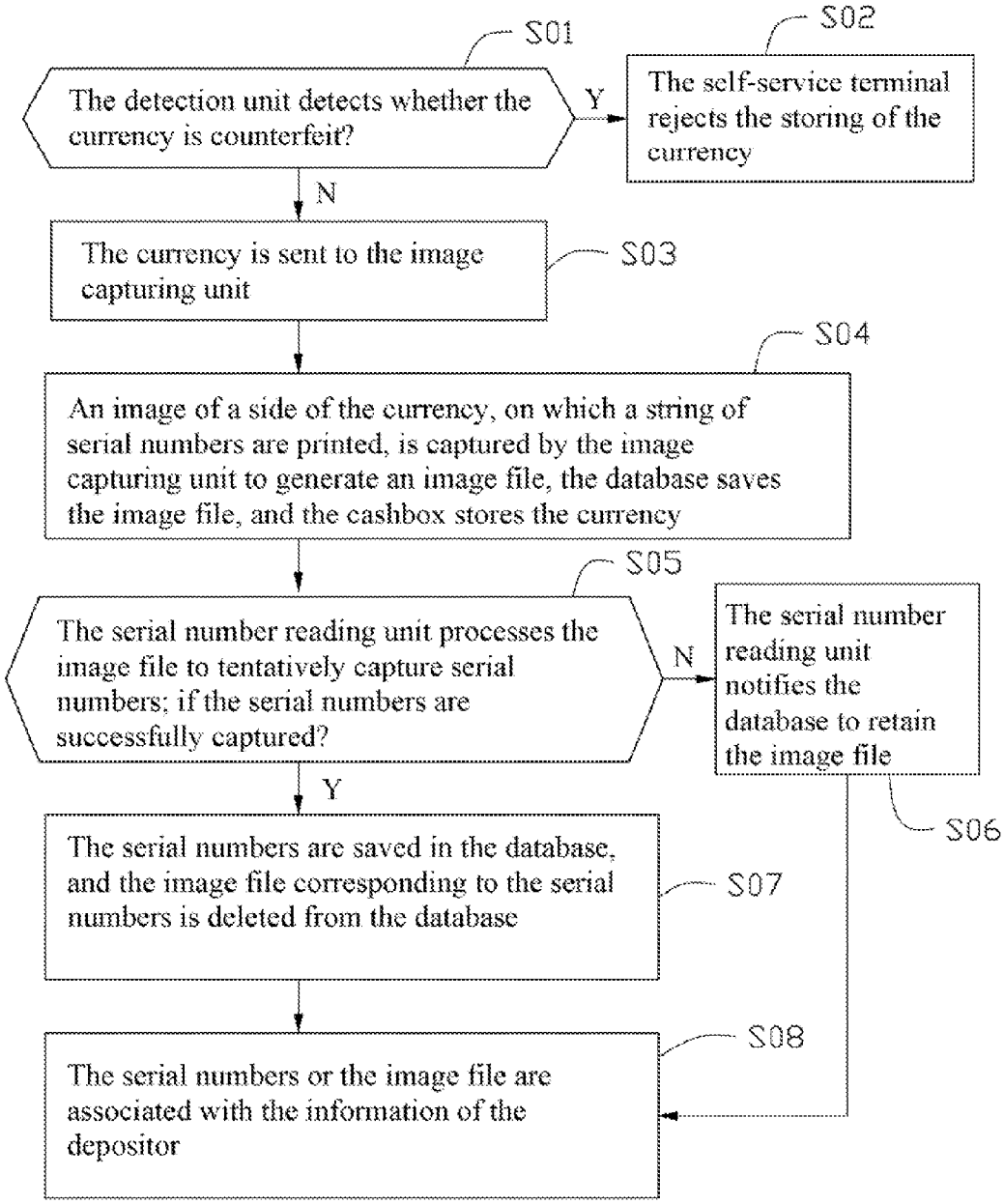
FIG. 2 is a flow chart of a method of storing currency in a self-service terminal.

Referring to FIG. 2, a flow chart of a method of processing currency in the self-service terminal is shown.

In step S01, after a depositor deposits currency in the self-service terminal, the detection unit 10 detects whether the currency is counterfeit. If the currency is counterfeit, it goes to step S02; if the currency is not counterfeit, it goes to step S03.

In step S02, the self-service terminal rejects the storing of the currency.

In step S03, the currency is sent to the image capturing unit 20. Then, it goes to step S04.

In step S04, an image of the side of the currency, on which a string of serial numbers are printed, is captured by the image capturing unit 20 to generate an image file. The image file is saved in the database 40, and the currency is stored in the cashbox 50. Then, it goes to step S05.

In step S05, the serial number reading unit 30 processes the image file to tentatively capture the serial numbers. If the serial number reading unit 30 successfully captures the serial numbers, it goes to step S06. If the serial number reading unit 30 does not successfully capture the serial numbers, it goes to step S07.

In step S06, the serial numbers are saved in the database 40, and the image file corresponding to the serial number is deleted from the database 40. Then, it goes to step S08.

In step S07, the serial number reading unit 30 notifies the database 40 to retain the image file. Then, it goes to step S08.

In step S08, the serial numbers or the image file are associated with the information of the depositor.

Therefore, after the currency is stored in the cashbox 50, information about the currency that is saved in the database 40. If the currency is found to be counterfeit later, the depositor who stored the counterfeit currency can be easily found.

It is to be understood, however, that even though numerous characteristics and advantages of the embodiments have been set forth in the foregoing description, together with details of the structure and function of the embodiments, the disclosure is illustrative only, and changes may be made in detail, especially in matters of shape, size, and arrangement of parts within the principles of the present disclosure to the full extent indicated by the broad general meaning of the terms in which the appended claims are expressed.

Depending on the embodiment, certain of the steps of methods described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

What is claimed is:

1. A method of storing currency in a self-service terminal comprising following steps:

determining whether currency deposited in a self-service terminal by a depositor is counterfeit;

rejecting the currency by the self-service terminal, if it is determined that the currency is counterfeit;

capturing an image of a side of the currency on which a string of serial numbers are printed by an image capturing unit, if it is determined that the currency is not counterfeit;

processing the image by a serial number reading unit to capture the string of serial numbers, storing the string of serial numbers, and associating the string of serial numbers with information of the depositor; and if the string of serial numbers cannot be successfully captured by the serial number reading unit, associating the image with the information of the depositor.

2. The method of storing currency of claim 1, wherein when the currency is detected to be true, a cashbox saves the currency therein.

3. The method of storing currency of claim 1, wherein the depositor's information is stored as a tag file, and a place and time about a transaction of storing currency are combined in the tag file after the image capturing unit captures the image.

4. A method of storing currency in a self-service terminal comprising following steps:

providing a self-service terminal comprising a detection unit, an image capturing unit, a serial number reading unit, and a database, the database comprising pre-stored information of depositors;

determining whether currency deposited in the self-service terminal by a depositor is counterfeit by the detection unit;

rejecting the currency by the self-service terminal, if it is determined that the currency is counterfeit;

capturing an image of a side of the currency on which a string of serial numbers are printed by the image capturing unit, if it is determined that the currency is not counterfeit;

processing the image to capture the string of serial numbers by the serial number reading unit, storing the string of serial numbers in the database, and associating the string of serial numbers with information of the depositor; and if the string of serial numbers cannot be successfully captured by the serial number reading unit, the image is associated with the information of the depositor.

* * * * *